US006796839B1

(12) United States Patent
Wu

(10) Patent No.: US 6,796,839 B1
(45) Date of Patent: Sep. 28, 2004

(54) ELECTRICAL CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/396,936

(22) Filed: Mar. 24, 2003

(51) Int. Cl.[7] ..... H01R 13/648
(52) U.S. Cl. ..... 439/607
(58) Field of Search ..... 439/607, 609, 439/610, 939, 564, 573, 608, 101, 83, 78

(56) References Cited

U.S. PATENT DOCUMENTS 5,967,846 A * 10/1999 Davis et al. ..... 439/609
6,050,852 A * 4/2000 Wu ..... 439/607
6,059,581 A * 5/2000 Wu ..... 439/79
6,109,967 A * 8/2000 Chiou ..... 439/607
6,203,353 B1 * 3/2001 Huang et al. ..... 439/352
6,241,556 B1 * 6/2001 Chih ..... 439/607
6,368,154 B1 4/2002 Hirata et al.
6,416,360 B1 * 7/2002 Zhang et al. ..... 439/607
6,575,774 B2 * 6/2003 Ling et al. ..... 439/108
6,619,986 B1 * 9/2003 Yeh ..... 439/607

* cited by examiner

*Primary Examiner*—Ross Gushi
*Assistant Examiner*—Phuongchi Nguyen
(74) *Attorney, Agent, or Firm*—Wei Te Chung

(57) ABSTRACT

An electrical connector (1) includes an insulating housing (10), a number of terminals (20) received in the housing, and a metallic shell (30) covering the housing. The metallic shell integrally forms a body section (31) and a retention section (32). The body section defines a semi-cavity (312) for receiving a complementary mating connector and has a pair of tabs (313) respectively stamped from two side panels (311) thereof. The tabs are retained in corresponding slots (120) defined in the housing to secure the housing and the shell. The retention section includes two retention portions (320) extending therefrom, each retention portion being press-fitted in corresponding recess defined in the housing so that the housing and the retention portion is substantially connected. The metallic shell also has a number of mounting pads (33) formed to be soldered on a printed circuit board on which the connector is mounted.

3 Claims, 4 Drawing Sheets

ELECTRICAL CONNECTOR

BACKGROUND OF THE INVENTION

1. Field of the Invention

The present invention generally relates to an electrical connector, and particularly to an electrical connector mounted on a printed circuit board.

2. Description of Prior Arts

Serial Advanced Technology Attachment (Serial ATA) connectors provide a storage interface for ATAPI (Advanced Technology Attachment Packet Interface) devices and hard disk drives, which are main storage peripheral devices of computer systems. Conventionally, a Serial ATA connector comprises an insulating housing and a plurality of terminals received in the housing. Such Serial ATA connectors can be found in U.S. Pat. No. 6,402,552 and Taiwan Patent Publication Nos. 493301, 493804, and 509393. Generally, the insulative housing of the Serial ATA connector includes a main portion, a mating portion extending from the main portion arranging the terminals thereon and one side arm extending from one lateral side of the main portion. The side arm defines a groove inside for guiding an insertion of a complementary mating connector. A space is defined between the lateral edge of the mating portion and the adjacent side arm. However, such conventional Serial ATA connectors usually suffer from a breaking problem over a period of use, being subjected to repeated inserting, extracting and shaking of a mated cable connector, which will adversely influence the signal transmission. Specifically, the housing will be easily broken along a vertical line on the side arm where the side arm connects to the main portion when the complementary connector is pulled in a right-and-left direction repeatedly. Similarly, the housing will be also easily broken along a horizontal line on the side arm where the side arm connects to the main portion and on the mating portion where the mating portion connects to the main portion when the complementary mating connector is pulled up and down repeatedly.

Hence, it is desirable to enhance the structural stability of Serial ATA connectors to ensure the signal transmission quality.

BRIEF SUMMARY OF THE INVENTION

Accordingly, it is a major object of the present invention to provide a Serial ATA connector having a metallic shell for improving the rigidity of the connector and improving overall connector integrity.

In order to achieve the above-mentioned object, a Serial ATA connector in accordance with the present invention for engaging a complementary connector and for mounting on a printed circuit board, includes an insulating housing, a plurality of terminals received in the housing, and a metallic shell partially covering the housing. The metallic shell integrally forms a body section and a retention section rewards extending from the body section. The retention section includes a pair of retention portions secured to the housing. The metallic shell also has a plurality of mounting pads extending from the body section and the retention section for soldering the connector on the printed circuit board.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
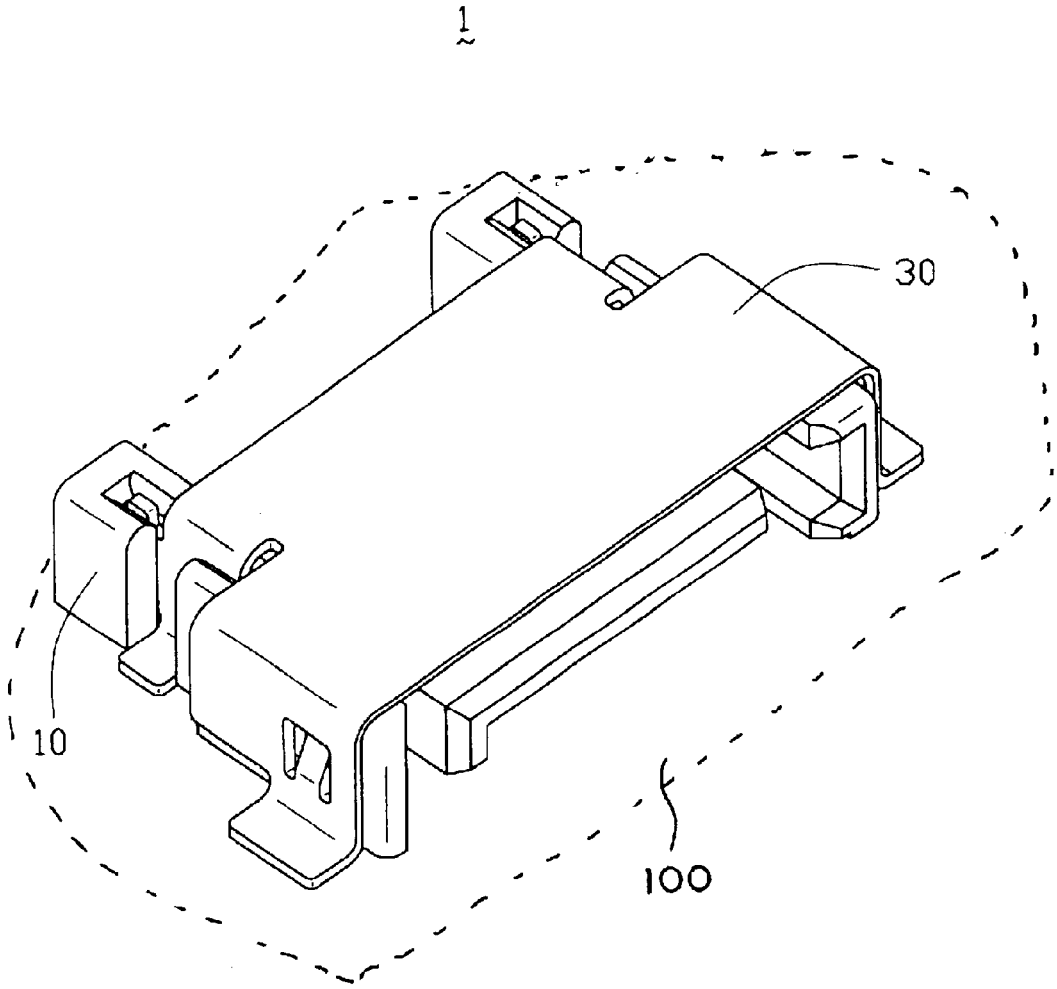
FIG. 1 is a perspective view of an electrical connector in accordance with the present invention.

Reference will now be made to the drawing figures to describe the present invention in detail.

With reference to FIGS. 1–4, a Serial ATA connector 1 in accordance with the present invention, which is mountable on a printed circuit board 100 and is adapted for mating with a complementary connector (not shown), comprises an insulating housing 10, a plurality of terminals 20 disposed in the housing 10, and a metallic shell 30 covering the housing 10.

Figure 3:
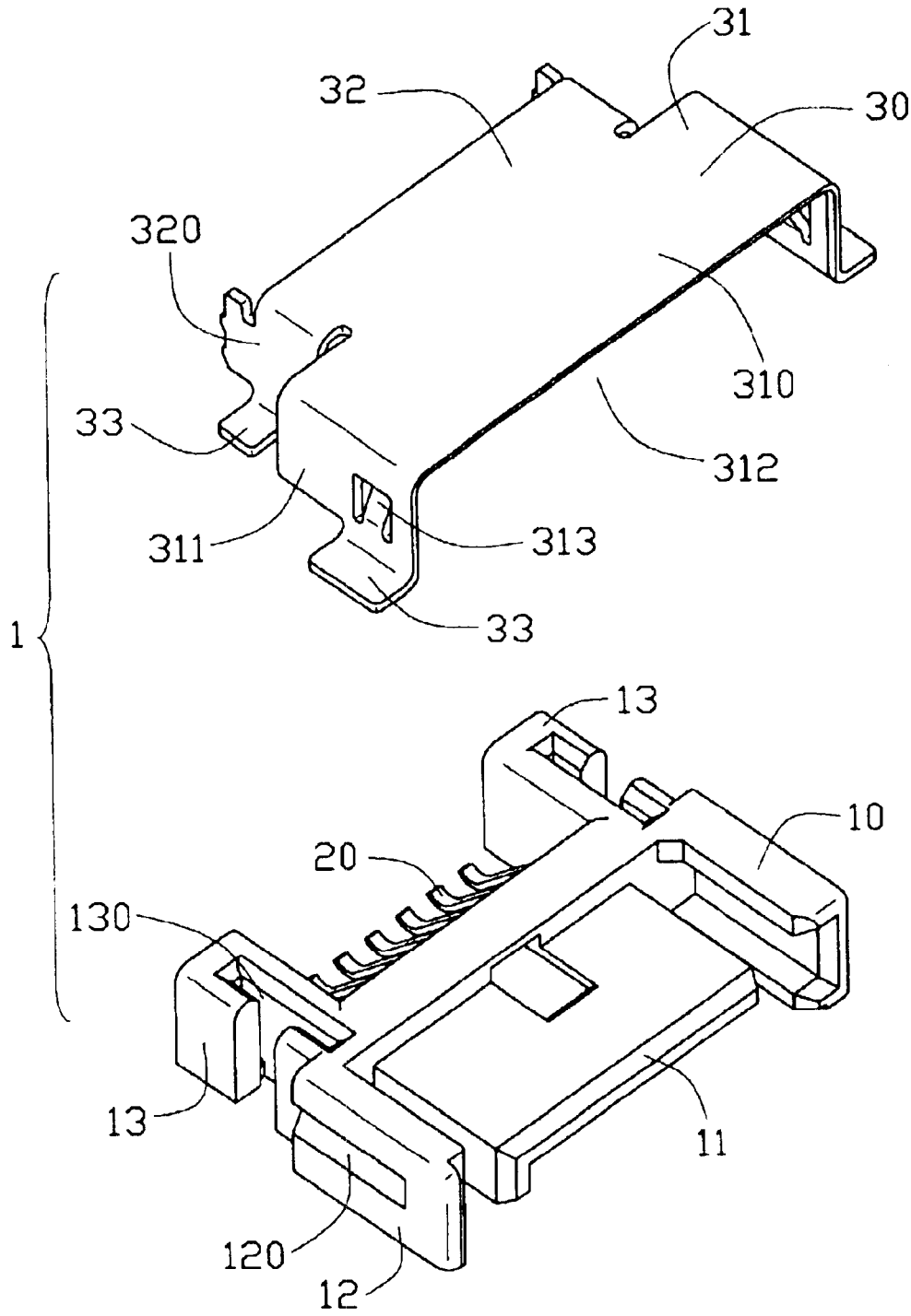
FIG. 3 is an exploded, perspective view of FIG. 1.
Figure 4:
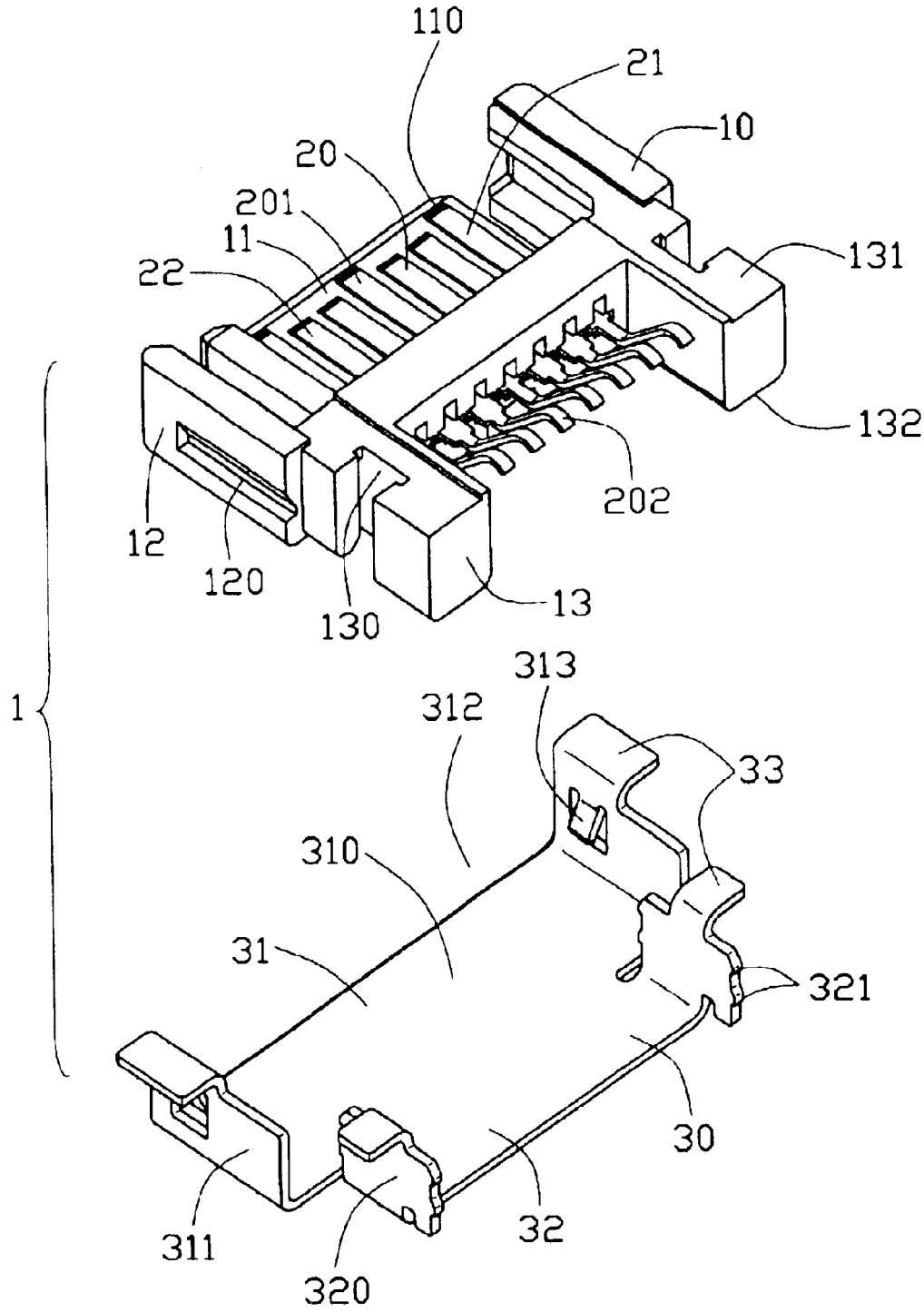
FIG. 4 is an exploded, perspective view of FIG. 2.

Particularly referring to FIGS. 3 and 4, the insulating housing 10 comprises a forwards projected, mating tongue 11, a pair of side arms 12 extending forwardly beside opposite sides of the mating tongue 11, and a pair of legs 13 oppositely extending from a rear side of the side arms 12, respectively. A plurality of channels 110 are defined throughout the mating tongue 11. Each side arm 12 defines an elongated slot 120 outside which extends in a forward direction. Each leg 13 comprises a vertical recess 130 recessed in a center and throughout the leg 13 from a top side 131 to a bottom side 132.

As best shown in FIG. 4, the terminals 20 are categorized with a plurality of signal terminals 22 and a plurality of ground terminals 21. The ground terminal 21 is longer than the signal terminal 22 such that the ground terminals 21 will engage with corresponding contacts of the complementary mating connector before the signal terminals 22 for hot plugging. The signal terminals 22 of the Serial ATA connector 1 of the preferred embodiment are employed to transmit differential signal pairs, which are known in the art. Each terminal 20 has a contact portion 201 extending in a corresponding channel 110 of the housing 10 and a tail portion 202 extending rearwardly between the two legs 13 for soldering on the printed circuit board on which the Serial ATA connector 1 is mounted.

Figure 2:
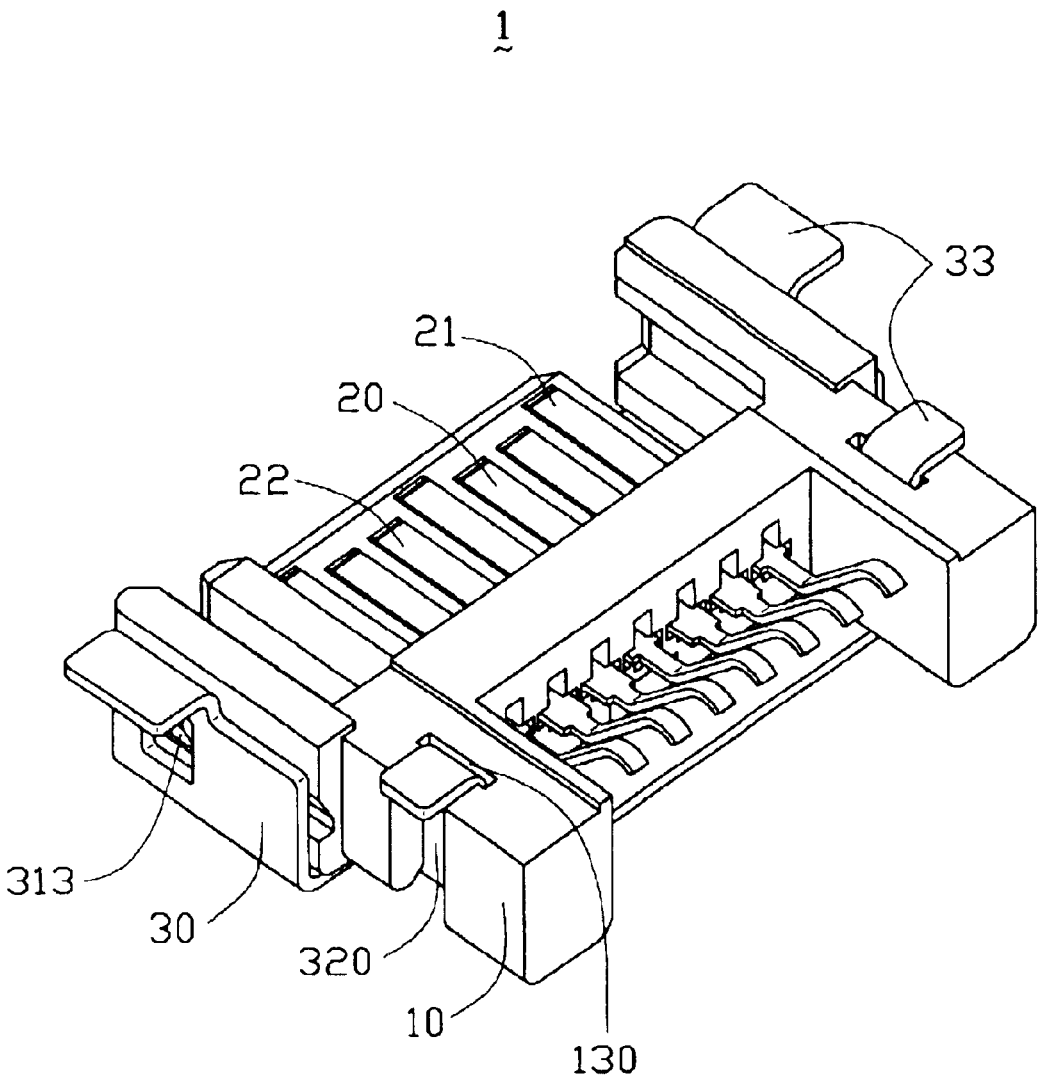
FIG. 2 is a reversed, perspective view of the connector of FIG. 1 adapted to be mounted on a printed circuit board.

Continue to FIGS. 3 and 4 in conjunction with FIGS. 1 and 2, the metallic shell 30 in the preferred embodiment is stamped from a piece of metal sheet. The metallic shell 30 comprises a body section 31 having a top panel 310 and two side panels 311. The top and side panels 310, 311 together define a cavity 312 therebetween, within which the complementary mating connector is received. An inwardly extending tab 313 is stamped in each side panel 311 for being retained in corresponding elongated slot 120 defined in the side arm 12 of the housing 10 to thereby secure the metallic shell 30 to the insulating housing 10. The metallic shell 30 further includes a retention section 32. The retention section 32 extends rearwardly from a rear side of the body section 31 and comprises a pair of retention portions 320 projecting downwardly from opposite sides thereof. Each retention portion 320 has a plurality of protrusions 321 (FIG. 4) protruded on opposite lateral edges so that the retention portions 320 are press-fitted in the vertical recesses 130 of the housing 10 to thereby firmly connecting the retention portion 32 and the housing 10. The metallic shell 30 also has a plurality of mounting pads 33 respectively formed with the body section 31 and the retention section 32. Specifically, the mounting pads 33 extend respectively from bottom edges of the side panels 311 of the body section 31 and bottom edges of the retention portions 320 of the retention section 32. The mounting pads 33 are formed to be soldered on the printed circuit board to thereby securely fixing the Serial ATA connector 1 on the printed circuit board. It should be noted here that the mounting pads 33 extending from the body section 31 and the mounting pads 33 extending from the retention section 32 are staggeredly arranged in the preferred embodiment to increase the stability of the connector 1 on the printed circuit board.

Compared with the related arts, the metallic shell 30 employed in the present invention not only facilitates securing the connector 1 on the printed circuit board but, of most significance, increases the whole rigidity of the connector 1 which protects the housing 10 from undesired breaking.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly comprising:

a printed circuit board;

an insulative housing seated upon the printed circuit board and defining a mating tongue spatially between a pair of opposite side arms, and a pair of legs extending generally in alignment with the corresponding side arms while in an opposite direction;

a plurality of terminals disposed in the housing with mating portions on the mating tongue and soldering portions between said pair of legs; and a metallic shell attached to the housing and including two opposite side panels covering the corresponding side arms and two opposite retention portions embedded in the corresponding legs; wherein said shell covers an upper side of the mating tongue, and the printed circuit board covers a lower side of the mating tongue.

2. The assembly as described in claim 1, wherein said side panels and said retention portions are equipped with mounting pads fastened to the printed circuit board.

3. An electrical connector assembly comprising:

a printed circuit board;

an insulative housing seated upon the printed circuit board and defining a mating tongue spatially between a pair of opposite side arms, and a pair of legs extending generally in alignment with the corresponding side arms while in an opposite direction;

a plurality of terminals disposed in the housing with mating portions on the mating tongue and soldering portions between said pair of legs; and a metallic shell attached to the housing and including a front area with a larger lateral dimension and a rear area with a smaller lateral dimension; wherein both said front area and said rear area include mounting pads soldered to the printed circuit board; wherein the mounting pads of the front area and those of the rear area are not aligned with each other along a front-to-back direction; wherein each of said front area and said rear are includes corresponding retention means, for retaining the shell to the housing, essentially aligned with the corresponding mounting pad in a vertical direction.

* * * * *